United States Patent [19]

Chandley et al.

[11] Patent Number: 5,069,271

[45] Date of Patent: Dec. 3, 1991

[54] COUNTERGRAVITY CASTING USING PARTICULATE SUPPORTED THIN WALLED INVESTMENT SHELL MOLD

[75] Inventors: George D. Chandley, Amherst; Richard T. Carter, Mount Vernon, both of N.H.

[73] Assignee: Hitchiner Corporation, Milford, N.H.

[21] Appl. No.: 662,338

[22] Filed: Feb. 25, 1991

Related U.S. Application Data

[63] Continuation-in-part of Ser. No. 579,319, Sep. 6, 1990, abandoned.

[51] Int. Cl.[5] ..... B22C 9/04; B22D 18/06

[52] U.S. Cl. ..... 164/516; 164/35; 164/63; 164/255

[58] Field of Search ..... 164/35, 34, 63, 255, 164/119, 306, 516, 517, 518, 519

[56] References Cited

U.S. PATENT DOCUMENTS

| | | | |
|---|---|---|---|
| 2,968,848 | 1/1961 | Carter . | |
| 3,186,041 | 6/1965 | Horton . | |
| 3,900,064 | 8/1975 | Chandley et al. . | |
| 4,050,500 | 9/1977 | Steinbacher | 164/16 |
| 4,068,704 | 1/1978 | Wittmoser . | |
| 4,340,108 | 7/1982 | Chandley et al. | 164/63 |
| 4,532,976 | 8/1985 | Chandley | 164/363 |
| 4,589,466 | 5/1986 | Chandley et al. | 164/119 |
| 4,617,977 | 10/1986 | Mills | 164/30 |
| 4,660,623 | 4/1987 | Ashton | 164/518 |
| 4,787,434 | 11/1988 | Cleary et al. | 164/34 |
| 4,791,977 | 12/1988 | Chandley | 164/63 |
| 4,830,085 | 5/1989 | Cleary et al. | 164/255 |
| 4,874,029 | 10/1989 | Chandley | 164/34 |
| 4,957,153 | 9/1990 | Chandley | 164/7.1 |

FOREIGN PATENT DOCUMENTS

| | | | |
|---|---|---|---|
| 276365 | 1/1964 | Australia | 164/35 |
| 2-15847 | 1/1990 | Japan | 164/34 |
| 556893 | 5/1977 | U.S.S.R. | 164/255 |
| 996089 | 2/1983 | U.S.S.R. | 164/63 |
| 1296294 | 3/1987 | U.S.S.R. | 164/63 |
| 1398980 | 5/1988 | U.S.S.R. | 164/255 |

*Primary Examiner*—J. Reed Batten, Jr.
*Attorney, Agent, or Firm*—Edward J. Timmer

[57] ABSTRACT

An expendable pattern of an article to be cast comprises a meltable material that expands upon heating (e.g., a wax pattern). The pattern is invested with particulate mold material to form a thin, layered shell having a wall thickness not exceeding about 0.12 inch. The thin shell wall thickness unexpectedly reduces damage and distortion to the shell during removal of the pattern therefrom by steam autoclaving. After firing, the thin gas permeable shell mold is surrounded by a refractory particulate support media in a vacuum housing. The vacuum housing is then evacuated to evacuate the mold cavity defined by the thin shell and concurrently a pressure is applied to the support media so as to compress the support media about the thin shell to support the shell against casting stresses when molten metal is countergravity cast into the evacuated mold cavity.

19 Claims, 3 Drawing Sheets

COUNTERGRAVITY CASTING USING PARTICULATE SUPPORTED THIN WALLED INVESTMENT SHELL MOLD

This is a continuation of copending application Ser. No. 579,319 filed on Sept. 6, 1990, and now abandoned.

FIELD OF THE INVENTION

The present invention relates to the countergravity casting of molten metal using a gas permeable investment shell mold provided with a thin mold wall that better tolerates pattern removal stresses and that is supported in a compacted particulate support media during the casting process.

BACKGROUND OF THE INVENTION

Vacuum-assisted countergravity casting processes using gas permeable investment shell molds are described in the Chandley U.S. Pat. Nos. 3,900,064; 4,340.108; 4,532,976; 4,589,466 and 4,791,977.

In the fabrication of the gas permeable, high temperature bonded refractory investment shell molds for use in such countergravity casting processes, a plurality of expendable (e.g., meltable) patterns of the article to be cast are first formed and then assembled with suitable ingate patterns and the like to form a pattern assembly or tree. The pattern assembly is then invested with refractory particulate by alternately dipping the pattern assembly in a refractory slurry (comprising refractory powder and a suitable binder solution capable of hardening during drying under ambient conditions) and then dusted or stuccoed with coarser refractory powder. The sequence of dipping and stuccoing is repeated to build up a multi-layered refractory shell having a sufficient thickness to resist stresses imparted thereto by subsequent pattern removal, firing and metal casting operations.

In particular, the pattern removal operation typically has been carried out by steam autoclaving wherein the invested pattern assembly is placed in a steam autoclave heated to a temperature in the range of about 275° F. to about 350° F. to melt out the pattern from the refractory shell. In the past, prior art workers have experienced damage (e.g., cracking) to the refractory shell during the steam autoclaving step as a result of thermal expansion of the pattern (e.g., wax) relative to the refractory shell. In efforts to reduce or minimize damage (e.g., cracking) of the refractory shell during the steam autoclaving step, prior art workers have increased the thickness of the shell to better withstand these stresses. Unfortunately, increasing the thickness of the refractory shell results in heavier investment shell molds and consumption of greater quantities of refractory material, adding to the cost of casting. Moreover, the greater thickness of the refractory shell also requires conduct of the steam autoclaving operation for longer times to effect removal of the pattern from the invested pattern assembly. Typically, investment shell molds used to countergravity cast iron base and other alloys using the aforementioned patented processes are made to have a shell wall thickness of at least about ¼ inch to this end.

Aforementioned U.S. Pat. No. 4,791,977 describes stresses imposed on the refractory shell mold during the vacuum-assisted countergravity casting of molten metal therein. In particular, that patent recognizes that harmful stresses can be imposed on the shell as a result of internal metallostatic pressure exerted thereon by the metal cast therein in conjunction with the external vacuum applied about the shell mold during the casting process. The patent recognizes that such stresses when combined with the high temperatures of the metal in the shell mold can cause shell wall movement, metal penetration into the walls, metal leakage and outright failure of the shell mold, especially if there are any structural defects in the shell. Although this patent provides a means of reducing such stresses on the investment shell mold (i.e., by using a differential pressure technique between the internal mold fill passage and vacuum chamber external of the shell), the investment shell mold used in that patent is still required to have a conventional shell wall thickness and strength to withstand stresses during pattern removal and molten metal casting.

It is an object of the present invention to provide an improved, economical countergravity casting method and apparatus that uses a refractory investment shell mold having a significantly reduced wall thickness that nevertheless is less subject to damage (e.g., cracking) during operations such as pattern removal by steam autoclaving.

It is another object of the present invention to provide an improved, economical countergravity casting method and apparatus which significantly reduces the amount of bonded refractory material needed to fabricate the investment shell mold.

It is still another object of the invention to provide an improved, economical countergravity casting method and apparatus which significantly increases the number of castings that can be cast per investment shell mold.

It is still a further object of the invention to provide an improved countergravity casting method and apparatus which reduces stresses imposed on the investment shell mold by the presence of internal metallostatic pressure and external vacuum conditions about the shell during casting.

It is still a further object of the invention to provide an improved countergravity casting method and apparatus which supports the investment shell mold during casting in such a manner as to prevent damage to the mold from casting stresses, permit larger molds to be cast and to prevent molten metal leakage therefrom.

SUMMARY OF THE INVENTION

The present invention contemplates an improved, economical countergravity casting method and apparatus involving forming an expendable pattern of an article to be cast and comprising a meltable material that expands upon heating, investing the pattern with particulate mold material in multiple layers so controlled as to form a refractory shell having a wall thickness not exceeding about 0.12 inch about the pattern and heating the invested pattern, such as by steam autoclaving, to remove the pattern from the shell to leave a mold cavity therein. After the thin shell is fired to impart desired mold strength thereto, a refractory particulate support media is disposed about the thin shell mold with the mold cavity communicated to a lower molten metal inlet disposed external of the support media.

After the thin refractory shell mold is surrounded by the particulate support media, the mold cavity is evacuated while, concurrently, a pressure is so applied to the support media as to compress the support media about the refractory shell to support the shell against casting stresses when the molten metal is countergravity cast into the evacuated mold cavity while the molten metal inlet is communicated to a source of molten metal.

Use of a refractory shell mold having a wall thickness not exceeding about 0.12 inch in the practice of the invention is based on the discovery, contrary to accepted prior art practice, that such thin shell walls are better able to tolerate stresses imposed thereon by pattern expansion during the pattern removal operation. In particular, the invention relates to the discovery that the permeability of thin shell molds does not increase in direct proportion to reductions in shell wall thickness but rather in an unexpectedly greater manner. For example, such thin shell walls (i.e., not exceeding about 0.12 inch wall thickness) have been found to exhibit a gas permeability of more than twice, generally greater than three times, the gas permeability of a like shell mold having twice the wall thickness.

This increased shell permeability has been found to relieve the stresses imposed on the shell during pattern removal by steam autoclaving by enhancing infiltration into the shell of the molten skin initially melted on the pattern. Moreover, the increased shell mold permeability shortens the time for pattern removal by facilitating ingress of the steam to the pattern surface.

Use of a refractory shell mold having such thin wall thickness (i.e., not exceeding about 0.12 inch) in practicing the invention is also based on the discovery that such a thin shell mold can be adequately supported to withstand stresses imposed thereon during differential pressure, countergravity casting by rigidizing or compressing a particulate support media about the shell concurrent with the mold cavity being evacuated.

For example, in one embodiment of the invention, the thin shell mold is disposed in a loose particulate support media (e.g., loose foundry sand) contained in a vacuum housing and a pressure transmitting means is moved relative to the vacuum housing and the support media to compress the support media about the shell when the vacuum housing is evacuated to evacuate the mold cavity for casting. The pressure transmitting means may comprise a movable wall of the vacuum housing that is subjected to ambient pressure on the outside and a relative vacuum on the inside to so compress the support media about the shell mold as to support the shell against casting stresses. The pressure transmitting means may alternately comprise a pressurized bladder disposed in contact with the support media for compressing the support media about the thin shell for the same purpose.

The aforementioned objects and advantages of the present invention will become more readily apparent from the following detailed description and drawings.

DETAILED DESCRIPTION OF THE PREFERRED EMBODIMENTS

Figure 1:
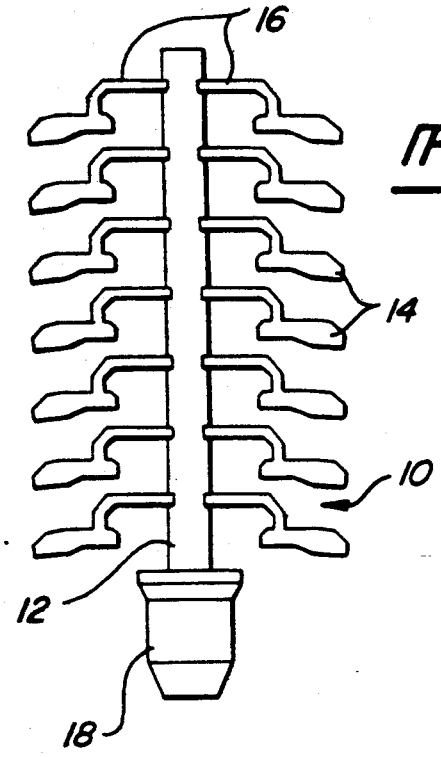
FIG. 1 is a side elevation of a pattern assembly.

Referring now to the drawings, there is shown in FIG. 1 an expendable pattern assembly or tree 10 comprising a central, cylindrical riser-forming portion 12 and a plurality of mold cavity-forming portions 14 each connected to the riser-forming portion 12 by a respective ingate-forming portion 16. The mold cavity-forming portions 14 are configured in the shape of the article or part to be cast and are spaced apart about the periphery of the riser-forming portion 12 and along the length thereof as shown. Typically, each mold cavity-forming portion 14 and its respective ingate-forming portion 16 are injection molded and then manually attached (e.g., wax welded or adhered) onto the riser-forming portion 12. The riser-forming portion 12 is formed by injection molding as a separate piece.

A refractory frusto-conical collar 18 is attached (e.g., wax welded or adhered) to the lower end of the riser-forming portion 12.

The pattern assembly 10 is preferably made of a meltable, solid (non-porous) material which expands upon heating as will be explained. Wax is the preferred material for the pattern assembly due to its low cost and predictable properties. In general, the pattern wax melts in the range of about 130° F. to about 150° F. Importantly, wax viscosity must be selected to avoid shell cracking during the pattern operation (e.g., wax viscosity at 170° F. should be less than 1300 centipoise). Urea may also be useful as a pattern material and melts in the range of about 235° F. to about 265° F.

It is not necessary in practicing the present invention that the various portions 12,14,16 of the pattern assembly 10 be made of the same pattern material so long as the pattern assembly 10 is subsequently removable by heating, such as steam autoclaving, as will be described.

Figure 2:
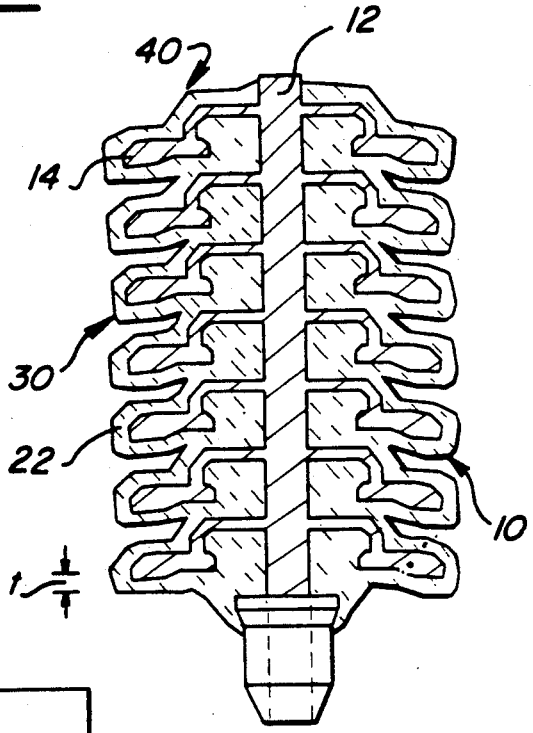
FIG. 2 is a sectioned, side elevation of the pattern assembly after investing with particulate mold material.

Referring now to FIG. 2, the pattern assembly 10 is invested with multiple layers of refractory material 22 to form a thin shell 30 thereabout. The pattern assembly is invested by repeatedly dipping it in a refractory slurry (not shown) comprising a suspension of a refractory powder (e.g., zircon, alumina, fused silica and others) in a binder solution, such as ethyl silicate or colloidal silica sol, and small amounts of an organic film former, a wetting agent and a defoaming agent. After each dipping, excess slurry is allowed to drain off and the slurry coating on the pattern assembly is stuccoed or sanded with dry refractory particles. Suitable refractory materials for stuccoing include granular zircon, fused silica, silica, various aluminum silicate groups including mullite, fused alumina and similar materials.

After each sequence of dipping and stuccoing, the slurry coating is hardened using forced air drying or other means to form a refractory layer on the pattern assembly 10 or on the previously formed refractory layer. This sequence of dipping, stuccoing and drying is repeated until a multi-layered shell 30 of desired wall thickness t about the mold cavity-forming portions 14 is built up.

In accordance with the present invention, the shell formation process (i.e., dipping, stuccoing and drying)

is controlled to form a multi-layer refractory shell 30 having a maximum wall thickness t not exceeding about 0.12 inch about the mold cavity-forming portions 14. As will be explained hereinbelow, this wall thickness has been discovered to exhibit a surprising ability to accommodate stresses imposed on the shell during pattern removal by steam autoclaving. In general, a shell wall thickness not exceeding about 0.12 inch is built up or comprised of four to five refractory layers formed by the repetitive dipping, stuccoing and drying sequence described hereinabove.

Figure 3:
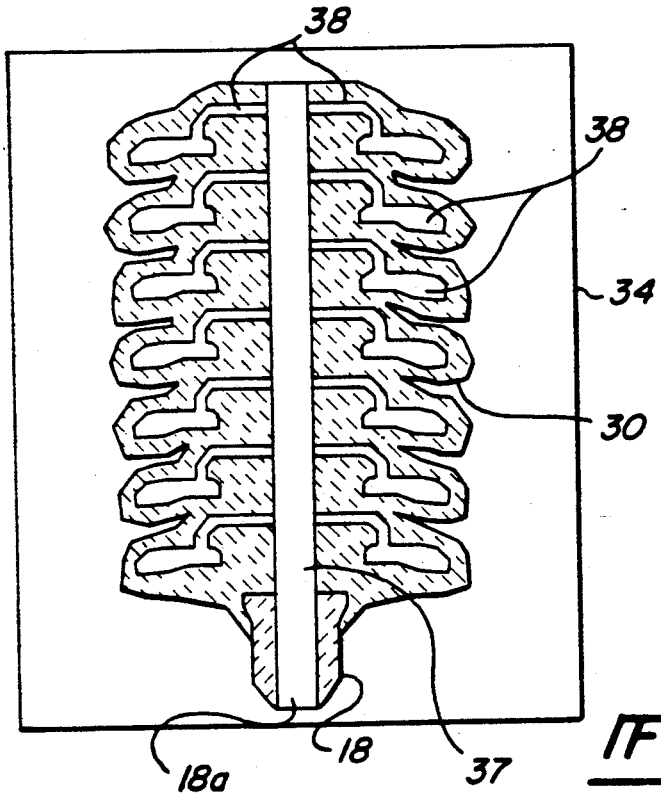
FIG. 3 is a sectioned, side elevation of the thin shell mold after the pattern assembly is removed by steam autoclaving.

FIG. 3 illustrates the refractory shell 30 after removal of the pattern assembly 10 by steam autoclaving. In particular, the refractory shell 30 is shown positioned inside a steam autoclave 34 (schematically shown) of conventional type; e.g., model 286PT available from Leeds and Bradford Co. As is apparent, removal of the pattern assembly 10 leaves a thin refractory shell 30 having the mold cavities 36 interconnected to the central riser 37 via the respective lateral ingates 38. At this stage of processing, the riser 37 is open at the lower and upper ends.

During the steam autoclaving operation, the invested pattern assembly 40, FIG. 2, is subjected to steam at a temperature of about 275° F. to about 350° F. (steam pressure of about 80 psi to about 110 psi) for a time sufficient to melt the pattern assembly 10 out of the refractory shell 30.

In particular, during the initial stages of steam autoclaving, a molten surface film is melted on the pattern assembly 10 by ingress of the steam through the gas permeable refractory shell 30. As will be explained hereinbelow, the permeability of the thin refractory shell 30 is surprisingly and unexpectedly able to absorb a major portion of this initial melted surface film and thereby relieve pattern expansion forces that would otherwise be exerted on the shell 30. Over time, the remainder of the pattern assembly 10 is melted and, for the most part, drains from the refractory shell 30 through the opening 18*a* in the collar 18 therein.

As mentioned hereinabove, the wall thickness of the refractory shell 30 is controlled in accordance with the invention so as not to exceed about 0.12 inch. This shell wall thickness has been found to exhibit an unexpectedly high permeability (e.g., as measured by a known nitrogen permeability test conducted at 1900° F. adopted by the Investment Casting Institute) for absorbing the initial melted surface film of pattern material during steam autoclaving. For example, a refractory shell 30 (fired) at about 1800° F. having a wall thickness of about 0.12 inch (4 refractory layers) has been measured (by the aforementioned nitrogen permeability test) to exhibit a gas permeability of more than twice that exhibited by a like shell having twice the thickness (i.e., a shell wall thickness of 0.25 inch and comprising eight refractory layers). In particular, the gas permeability of the fired refractory shell 30 of 0.12 inch wall thickness was measured as 316–468 cc of $N_2$/minute compared to only 80–120 cc of $N_2$/minute for the like shell of 0.25 inch wall thickness.

Preferably, the fired refractory shell 30 is so formed in accordance with the invention as to exhibit a gas permeability of at least generally three times that of a like shell of twice the wall thickness.

As already mentioned, this unexpectedly high permeability of the thin refractory shell 30 (not exceeding 0.12 inch wall thickness) enhances the ability of the refractory shell wall to absorb the initial melted surface film on the pattern assembly 10 formed during steam autoclaving to relieve any stresses that would normally be imposed on the shell as a result of thermal expansion of the pattern assembly 10 relative to the refractory shell 30. Contrary to the prior art practice of increasing the shell wall thickness to withstand such stresses during pattern removal, the present invention has discovered that a decreased (thinner) shell wall thickness provides a significantly improved response to steam autoclaving with reduced shell distortion and damage, such as cracking. Not only is shell distortion and damage reduced but also the time required for pattern removal by steam autoclaving is substantially reduced by virtue of better ingress of the steam through the high permeability shell 30 and resulting faster heating of the pattern assembly 10.

Moreover, as will become apparent from the examples set forth in Table I below, the quantity of refractory particulate required for the refractory shell 30 is significantly reduced since a thinner shell wall thickness is used. The cost of casting is thereby significantly reduced; e.g., cost reductions of 40% to 75% are achievable based upon savings in the amount of refractory material used.

In addition, the use of a thin-walled shell mold permits closer spacing of the mold cavity-forming portions 14 and the ingates 16 to substantially increase the number of castings that can be made per mold. Overall production output is increased at reduced cost in like manner (except for wall thickness).

After steam autoclaving the shell is fired at about 1800° F. for 90 minutes.

Table I sets forth comparative data relating to a so-called loading factor (i.e., the number of parts castable per mold) for a given part (e.g., an automobile rocker, window latch and a cleat) when using thick-walled shells (i.e., 0.25 inch shell wall thickness) and when using the thin-walled shells 30 of the invention. Both the thick-walled shell (9 slurry dips/stuccoes) and the thin-walled shell (4–5 slurry dips/stuccoes) were prepared in like manner using like slurries and stuccoes (e.g., initial slurry dip containing 200 mesh fused silica (15.2 weight %) and 325 mesh zircon (56.9 weight %), colloidal silica sol binder (17.8 weight %) and water (10.1 weight %) and subsequent slurry dips containing Mulgrain® M-47 mullite (15.1 weight %), 200 mesh fused silica (25.2 weight %) and 600 mesh zircon (35.3 weight %), ethyl silicate binder (15.6 weight %) and isopropanol (8.8 weight %) and stuccoed in sequence by about 100 mesh zircon, 60 mesh Mulgrain M-47 mullite and the balance being stuccoed by about 25 mesh Mulgrain M-47 mullite. The shells were steam autoclaved and then fired as described above.

Also compared is the weight of thick-wall shell (i.e., 0.25 inch wall thickness) used previously for the parts and the weight of the thin-walled shell (i.e., about 0.10 inch wall thickness) of the invention.

TABLE I

| SHELL LOADING AND FINAL REFRACTORY WEIGHT | | | | | | |
|---|---|---|---|---|---|---|
| | Std. Shell Loading | Thin Shell Loading | Std. Shell Weight | | Thin Shell Weight | |
| Part | pce/shell | pce/shell | change % | oz/pce | oz/pce | change % |
| Rocker arm | 8 ar × 13 hi 104/shell | 12 ar × 16 hi 192/shell | 85 | 6.3 | 1.5 | 76 |
| Window latch | 12 ar × 8 hi 96/shell | 14 ar × 10 hi 140/shell | 46 | 6.7 | 1.5 | 63 |
| Cleat | 10 ar 24 hi 204/shell | 12 ar × 26 hi 312/shell | 30 | 2.8 | 1.3 | 54 |

Note: "ar" is # of mold cavities around riser and "hi" is # of levels of mold cavities along riser From Table I, it is apparent that the thinner shell molds of the invention significantly increase the loading factor (i.e., parts castable per mold) and significantly reduce the amount of refractory material needed to form the fired shell. All this is achieved while also achieving equivalent or better values for mold distortion and damage during the steam autoclaving operation.

Figure 4:
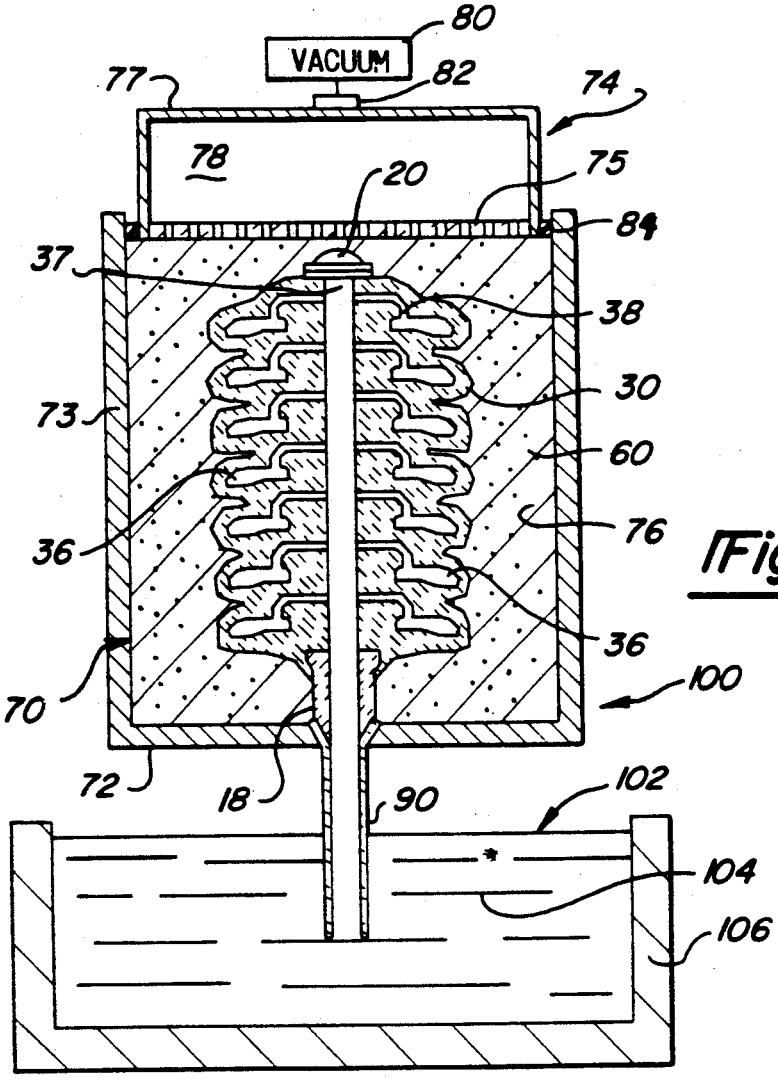
FIG. 4 is a sectioned side elevation of a countergravity casting apparatus in accordance with the invention wherein the shell mold is disposed in rigidized particulate support media in a vacuum housing and the external molten metal inlet to the shell mold is immersed in an underlying pool of molten metal.

In accordance with one embodiment of the invention, molten metal is differential pressure, countergravity cast into the thin shell mold 30 (after the shell is fired at about 1800° F.) as illustrated in FIG. 4. In particular, the thin shell mold 30 is supported in a loose refractory particulate support media 60 itself contained in a vacuum housing 70. The vacuum housing 70 includes a bottom support wall 72, an upstanding side wall 73 and a movable top end wall 74 defining therewithin a vacuum chamber 76. The bottom wall 72 and the upstanding side wall 73 are formed of gas impermeable material, such as metal, while the movable top end wall 74 comprises a gas permeable (porous) plate 75 having a vacuum plenum 77 connected thereto to define a vacuum chamber 78 above (outside) the gas permeable plate 75. The vacuum chamber 78 is connected to a source of vacuum, such as a vacuum pump 80, by conduit 82. The movable top end wall 74 includes a peripheral seal 84 that sealingly engages the interior of the upstanding side wall 73 to allow movement of the top end wall 74 relative to the side wall 73 while maintaining a vacuum seal therebetween.

In assembly of the components shown in FIG. 4 to form the casting apparatus 100, FIG. 4, a ceramic fill tube 90 disposed in housing 70 and providing a lower molten metal inlet to the mold cavities 36 via the riser 37 and the respective ingates 38 is sealingly engaged to the frusto-conical collar 18 as the mold is placed thereon. A refractory cap 20 is placed atop the shell mold to close off the upper end of the riser 37. The loose refractory particulate support media 60 (e.g., loose foundry silica sand of about 60 mesh) is introduced into the vacuum chamber 76 about the fired shell 30 while the housing 70 is vibrated to aid in settling of the support media 60 in the chamber 76 about the shell 30. The movable top end wall 74 is then positioned in the open upper end of the housing 70 with the peripheral seal 84 sealingly engaging the upstanding side wall 73 and with the inner side of the gas permeable plate 75 facing and in contact with the support media 60, FIG. 4.

After assembly, the casting apparatus 100 is positioned above a source 102 (e.g., a pool) of the molten metal 104 to be cast. Typically, the molten metal 104 is contained in a casting vessel 106. A vacuum is then drawn in the vacuum chamber 78 of the vacuum bell 77 and hence in the vacuum chamber 76 through the gas permeable plate 75 by actuation of the vacuum pump 80. Evacuation of the chamber 76, in turn, evacuates the mold cavities 36 through the thin gas permeable shell wall. The level of vacuum in chamber 76 is selected sufficient to draw the molten metal 104 upwardly from the pool 102 into the mold cavities 3 when the fill tube 90 is immersed in the molten metal 104 as shown in FIG. 4.

When the vacuum is drawn in vacuum chambers 76,78, the top end wall 74 is subjected to atmospheric (or ambient) pressure on the side thereof external of the peripheral seal 84 while the inner side of the plate 75 is subjected to a relative vacuum. This pressure differential across the top end wall 74 causes the top wall 74 to move downwardly relatively to side wall 73 and causes the plate 75 to exert sufficient pressure on the support media 60 so as to compress or rigidize the support media 60 about the shell 30 to support it against casting stresses. Thus, while the mold cavities 36 are evacuated to draw the molten metal upwardly from the pool 102, a pressure is applied concurrently by the plate 75 to compress the support media 60 about the shell 30 to support it against casting stresses. The amount of pressure applied by the plate 75 to compress the support media 60 can be controlled by controlling the level of vacuum established in the vacuum chamber 76.

As is apparent from FIG. 4, the molten metal 104 will be drawn upwardly through the fill tube 90 through the riser 37 and into the mold cavities 36 via the lateral ingates 38. The molten metal 104 is thereby vacuum countergravity cast into the mold cavities 36.

When the relative vacuum is established in vacuum chamber 76,78, it is apparent that upper end of the riser 37 will be closest to the highest vacuum level in chamber 78. Moreover, it will be apparent that the support media 60 will act to reduce the vacuum level existing external of the shell 30 in proximity to its bottom. As a result, the stress imposed on the lower portions of the shell 30 by the combination of the internal metallostatic head and the external vacuum about the shell mold 30 is reduced in accordance with the principles of U.S. Pat. No. 4,791,977. This reduction in stress in conjunction with support of the shell 30 by the support media 60 permits countergravity casting of the high temperature molten metal 104 into the thin shell 30 (having a wall thickness not exceeding about 0.12 inch) without harmful mold wall movement and molten metal penetration into the mold wall.

Should any small opening or similar defect be present in the shell 30, the surrounding support media 60 also aids in preventing the molten metal 104 from leaking through the defect and, in any event, confines any leakage in proximity to the shell 30 to prevent damage to the casting apparatus, permitting vacuum to be held until the castings solidify.

Once the molten metal 104 solidifies in the mold cavities 36, the casting assembly 100 is moved upwardly to remove the fill tube 90 from the molten metal pool. The top wall 74 of the housing 70 is then removed at an unload station (not shown) to allow removal of the support media 60 and the metal-filled shell 30 from the vacuum chamber 76. After cooling, the support media 60 can be recycled for reuse in casting another shell 30. After removal from the vacuum chamber 76, the metal-filled shell 30 is allowed to cool to ambient. The shell 30 is easily removed from the solidified casting by virtue of its thin wall thickness. For example, cooling of the metal-filled shell 30 often causes the shell 30 to simply pop off the casting due to thermal stresses imposed on the shell during cooling. In general, considerably less time is required to remove the thin shell 30 than to remove shell molds having thicker wall thicknesses heretofore used.

Figure 5:
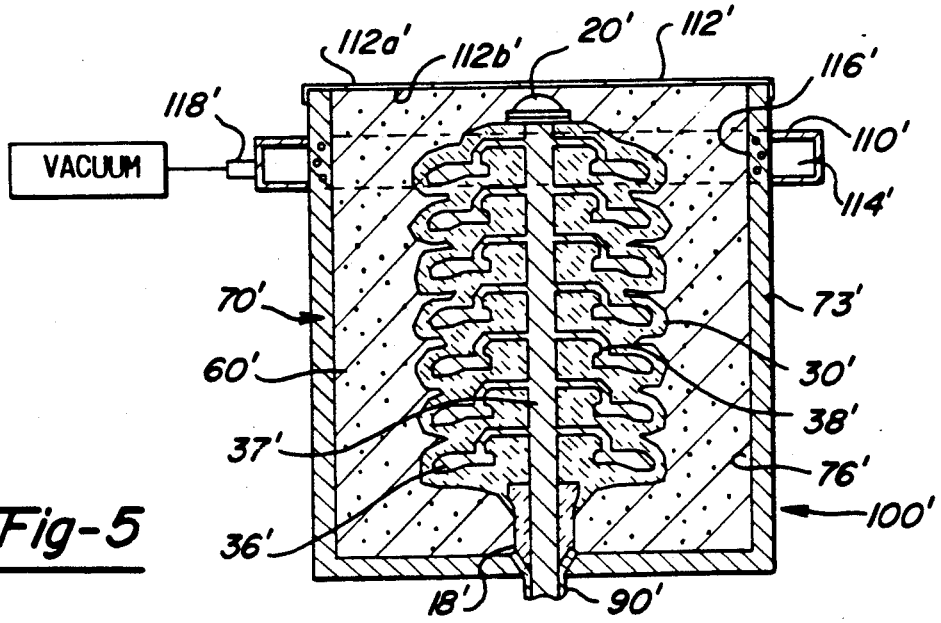
FIG. 5 is a sectioned side elevation of a countergravity casting apparatus in accordance with another embodiment of the invention.

Referring to FIG. 5, a casting apparatus 100' of another embodiment of the invention is illustrated. In FIG. 5, like features of FIG. 4 are represented by like reference numerals primed. The casting apparatus 100' of FIG. 5 differs from the casting apparatus 100 of FIG. 4 in using an annular vacuum bell 110' about the housing 70' and a flexible, gas impermeable membrane 112' sealingly disposed on the open upper end of the housing 70' (providing a movable housing top end wall) for applying a pressure to the support media 60' when the housing 70' is evacuated. The vacuum plenum 110' defines an annular vacuum chamber 114' about the vacuum chamber 76' of the housing 70' and is interconnected thereto by an annular gas permeable (porous) side wall housing section 116'.

As will be apparent, when the vacuum chamber 14' is evacuated (via conduit 118'), the vacuum chamber 76' and the mold cavities 36' of the shell 30' are, in turn, evacuated.

When the vacuum is drawn in the vacuum chamber 76', the flexible, gas impermeable membrane 112' is subjected to atmospheric pressure on the outside surface **112*a'* and to the relative vacuum on the inside surface 112*b'*, causing the membrane 112' to compress the loose refractory particulate support media 60' about the thin shell mold 30' to support it against casting stresses in the manner described hereinabove with respect to FIG. 4 as the molten metal is urged upwardly from the underlying pool through the fill tube 90' and the riser 37' and into the mold cavities 36' via the ingates 38'. In other respects, the embodiment of FIG. 5 functions and offers advantages described above for the embodiment of FIG. 4**.

Figure 6:
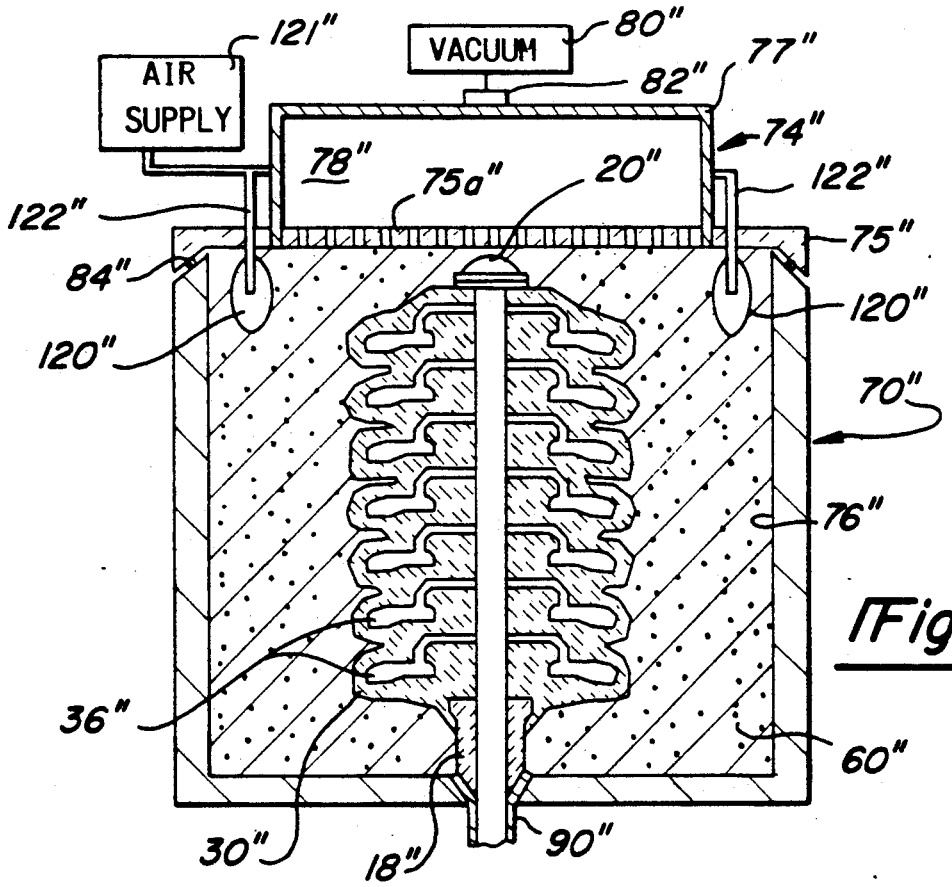
FIG. 6 is a sectioned side elevation of a countergravity casting apparatus in accordance with still another embodiment of the invention.

Referring to FIG. 6, a casting apparatus 100'' of still another embodiment of the invention is illustrated wherein like features of FIG. 4 are represented by like reference numerals double primed. The embodiment of FIG. 6 differs from that of FIG. 4 in using one or more annular fluid pressurizable bladders 120'' (one shown) disposed in contact with the refractory particulate support media 60'' in the housing 70'' to exert a pressure on the support media 60'' to compress it about the thin shell mold 30'' when the mold cavities 36'' are evacuated during countergravity casting. The housing 70'' includes a non-movable top end wall 74'' which comprises a gas permeable plate 75'' sealed to the top of the housing 70'' by seal 84'' and a vacuum bell 77'' connected to the plate 75''. The vacuum chamber 78'' of the bell 77'' overlies the gas permeable portion **75*a* '' of the plate 75'' so as to evacuate the vacuum chamber 76'' of the housing 70'' by a means of vacuum pump 80'' communicating thereto via conduit 82''**.

After the top end wall 74'' is sealed to the housing 70'' and the chambers 76'',78'' are evacuated, the bladder 120'' is pressurized by a suitable gas supply 121'', such as compressed air, through suitable gas supply pipes 122''. Pressurization of the bladder 120'' exerts a pressure on the refractory particulate support media 60'' to compress it about the shell 30'' to support it against casting stresses in the same manner as described hereinabove for the preceding embodiments. In other respects, the embodiment of FIG. 6 is similar in function to the preceding embodiments of FIGS. 4 and 5.

While the invention has been described in terms of specific embodiments thereof, it is not intended to be limited thereto but rather only to the extent set forth hereafter in the claims which follow.

I claim:

1. A method of countergravity casting molten metal, comprising the steps of:

(a) forming an expendable pattern of an article to be cast, said pattern comprising a meltable material that expands upon heating, (b) investing the pattern with particulate refractory mold material in multiple layers so controlled as to form a thin, refractory shell having a wall thickness not exceeding about 0.12 inch, (c) heating the invested pattern to remove the pattern from the thin shell to leave a mold cavity therein, (d) disposing a refractory particulate support media about the thin shell with the mold cavity communicated to a lower molten metal inlet disposed external of the support media, (e) evacuating the mold cavity, (f) applying such a pressure to the support media while the mold cavity is evacuated as to compress the support media about the thin shell to support said shell against casting stresses, and (g) countergravity casting the molten metal upwardly into the evacuated mold cavity while the molten metal inlet is communicated to an underlying source of the molten metal and the shell is supported in the support media.

2. The method of claim 1 wherein the thin, layered shell is so formed as to exhibit a gas permeability more than twice that exhibited by a like shell having twice the wall thickness.

3. The method of claim 2 wherein the shell is so formed as to exhibit a gas permeability of at least three times that exhibited by said like shell.

4. The method of claim 1 wherein in step (c) the invested pattern is steam autoclaved to remove the pattern.

5. The method of claim 1 wherein in step (d), the shell is supported in the support media inside a vacuum housing and a pressure transmitting means is moved relative to the vacuum housing and the support media when the housing is evacuated to exert said pressure on the support media.

6. The method of claim 5 wherein the pressure transmitting means comprises a movable wall of the housing for pressing on the support media.

7. The method of claim 6 wherein the wall is subjected to a relative vacuum on the inner side thereof and ambient pressure on the outer side thereof.

8. The method of claim 5 wherein the pressure transmitting means comprises a bladder disposed in contact with the support media in the housing and pressurized to compress the support media when the mold cavity is evacuated.

9. The method of claim 1 wherein the expendable pattern comprises wax.

10. The method of claim 1 wherein the expendable pattern comprises urea.

11. A method of countergravity casting molten metal, comprising:

(a) forming an expendable pattern of an article to be cast, said pattern comprising a meltable material that expands upon heating, (b) investing the pattern with particulate refractory mold material in multiple layers so controlled as to form a thin, refractory shell having a wall thickness not exceeding about 0.12 inch, (c) steam autoclaving the invested pattern to remove the pattern from the thin shell to leave a mold cavity therein, (d) surrounding the thin shell in a refractory particulate support media contained in a vacuum chamber with said mold cavity communicated to a lower molten metal inlet disposed external of said vacuum chamber, (e) evacuating the chamber to evacuate the mold cavity, (f) applying such a pressure to the support media while the chamber is evacuated as to compress the support media about the thin shell to support said shell against casting stresses, and (g) countergravity casting the molten metal upwardly into the evacuated mold cavity while the molten metal inlet is communicated to an underlying source of molten metal and the shell is supported in the support media.

12. Apparatus for countergravity casting of molten metal, comprising:

(a) refractory particulate support media disposed in a housing, (b) a refractory investment shell disposed in the support media, said shell having a mold cavity defined by a mold wall thickness not exceeding about 0.12 inch, (c) a lower molten metal inlet disposed external of the support media for communicating the mold cavity and an underlying source of the molten metal, (d) means for evacuating the mold cavity, (e) means for applying such a pressure to the support media while the mold cavity is evacuated as to compress the support media about the shell to support it against casting stresses, and (f) means for communicating the molten metal inlet to said source when the mold cavity is evacuated and the pressure is applied to the support media so as to urge the molten metal upwardly into the evacuated mold cavity.

13. The apparatus of claim 12 wherein said molten metal inlet comprises a fill tube extending from the shell external of the support media.

14. The apparatus of claim 12 wherein the means for applying pressure to the support media comprises a movable wall of said housing, said movable wall being subjected to such a differential pressure when the chamber is evacuated as to cause said wall to move relative to the housing and support media to compress the support media about the shell.

15. The apparatus of claim 14 wherein the movable wall comprises a gas permeable end wall of the housing, said end wall having an inner side for contacting the support media and a vacuum bell overlying the outer side thereof, said vacuum bell being evacuable on the inside to evacuate the chamber through the gas permeable member and being subjected to ambient pressure on the outside thereof such that said wall moves relative to the housing to press on the support media when said chamber is evacuated.

16. The apparatus of claim 14 wherein the movable wall comprises a gas impermeable, flexible end wall of the housing.

17. The apparatus of claim 12 wherein the means for applying pressure to the support media comprise a pressurizable bladder disposed in contact with the support media in the chamber.

18. The apparatus of claim 12 wherein the refractory particulate support media comprises loose foundry sand.

19. Apparatus for countergravity casting of molten metal, comprising:

(a) a housing having a vacuum chamber, (b) loose refractory particulate support media disposed in the chamber, (c) a refractory investment shell disposed in the support media, said shell having a mold cavity defined by a mold wall thickness not exceeding about 0.12 inch, (d) a lower molten metal inlet disposed external of the vacuum chamber for communicating the mold cavity and an underlying source of the molten metal, (e) means for evacuating the chamber to evacuate the mold cavity, (f) means for applying such a pressure to the support media while the chamber is evacuated as to compress the support media about the shell to support it against casting stresses, and (g) means for communicating the molten metal inlet to said source while the chamber is evacuated and the pressure is applied to the support media so as to urge the molten metal upwardly into the evacuated mold cavity.

* * * * *